US005727576A

United States Patent [19]

Eren

[11] Patent Number: 5,727,576

[45] Date of Patent: Mar. 17, 1998

[54] MULTI-PURPOSE HAIRSTYLING DEVICE

[76] Inventor: Mahire Eren, 20 St. Andrews Rd., Severna Park, Md. 21146

[21] Appl. No.: 593,429

[22] Filed: Jan. 29, 1996

[51] Int. Cl.[6] ..... A45D 2/00; A45D 37/00

[52] U.S. Cl. ..... 132/221; 132/246; 132/247; 132/248; 132/253

[58] Field of Search ..... 132/221, 246, 132/247, 248, 253, 273, 245

[56] References Cited

U.S. PATENT DOCUMENTS

| | | | |
|---|---|---|---|
| 195,455 | 9/1877 | Rose . | |
| 323,184 | 7/1885 | Matzinger . | |
| 731,861 | 6/1903 | Connell . | |
| 1,397,532 | 11/1921 | McClaire . | |
| 1,406,586 | 2/1922 | Scheib . | |
| 1,490,293 | 4/1924 | Scheib . | |
| 1,844,644 | 2/1932 | Eisler . | |
| 1,908,970 | 5/1933 | Frankel . | |
| 1,916,943 | 7/1933 | Beadle | 132/246 |
| 1,917,341 | 7/1933 | Thau . | |
| 2,061,356 | 11/1936 | Gosewisch . | |
| 2,061,817 | 11/1936 | Van Cleef | 132/221 |
| 2,146,674 | 2/1939 | Huppert . | |
| 2,152,673 | 4/1939 | Solomon . | |
| 2,308,819 | 1/1943 | McFadden et al. . | |
| 2,525,981 | 10/1950 | Webster . | |
| 2,542,601 | 2/1951 | VanCleef . | |
| 2,600,727 | 6/1952 | Berman et al. | 132/221 |
| 2,693,809 | 11/1954 | Spencer . | |
| 3,003,505 | 10/1961 | Otto et al. | 132/221 |
| 4,310,008 | 1/1982 | Lalli . | |
| 4,648,414 | 3/1987 | Fox et al. | 132/246 |
| 4,844,103 | 7/1989 | Vick et al. . | |
| 5,303,723 | 4/1994 | Schach | 132/246 |
| 5,372,152 | 12/1994 | Dutch | 132/246 |
| 5,494,059 | 2/1996 | Barrows et al. | 132/273 |

FOREIGN PATENT DOCUMENTS

| | | |
|---|---|---|
| 1261901 | 4/1961 | France . |
| 1915547 | 10/1970 | Germany . |
| 479610 | 2/1938 | United Kingdom . |
| 503226 | 4/1939 | United Kingdom . |

*Primary Examiner*—Gene Mancene
*Assistant Examiner*—Philogene Pedro
*Attorney, Agent, or Firm*—Clyde I. Coughenour

[57] ABSTRACT

A hairstyling device includes a material that is elongated soft, resilient, lightweight in combination with a semi-rigid loop that is bendable enough to shape, but stiff enough to assume and retain any shape it is bent into. The loop extends beyond the material and along the outer surface of the material. The loop has second and third pliable extensions attached to it beneath the ends of the material. The extensions can be retained beneath the material or extended outwardly and bent back for securing hair, or bent and attached to each other to hold the material in a circular oval or other shape.

20 Claims, 1 Drawing Sheet

MULTI-PURPOSE HAIRSTYLING DEVICE

BACKGROUND OF THE INVENTION

1. Field of the Invention

A hairstyling device is disclosed for arranging hair in different configurations. An elongated resilient material is used in combination with pliable semi-rigid elements that secure hair and are used to shape the elongated resilient material.

2. Description of the Related Art

Hairstyling devices have been in use for centuries. Devices in use have included a rod or wire core through a resilient material such as a sponge rubber or a foam with Van Cleef, U.S. Pat. No. 2,061,817, issued 24 Nov. 1936, and Fox et al, U.S. Pat. No. 4,648,414 issued 10 Mar. 1987, examples. It has been suggested that the core or wire extend beyond the resilient material so that it can be bent back on itself to clamp hair onto the device with Solomon, U.S. Pat. No. 2,152,673, issued 4 Apr. 1939, and Guglielmi, FR Patent No. 1,261,901 of 17 Apr. 1961, examples. It is also known that end extensions can be attached together to shape a device with Rose, U.S. Pat. No. 195,455, issued 25 Sep. 1877, and Webster, U.S. Pat. No. 2,525,981, issued 17 Oct. 1950, examples. Elastic bands have been provided adjacent the surface of resilient hair contacting portions of devices with Connell, U.S. Pat. No. 731,861, issued 23 Jun. 1903, and Gosewisch, U.S. Pat. No. 2,061,356, issued 17 Nov. 1936, examples. Huppert, U.S. Pat. No. 2,146,674, issued 7 Feb. 1939, and Vick et al, U.S. Pat. No. 4,844,103, issued 4 Jul. 1989, teach wires through resilient material for shaping hair styling devices. Huppert extends the wire outwardly from a flexible resilient material while the extensions are bent over to secure the hair in position. Vick et al use an independent band to secure hair to their device. Thau, U.S. Pat. No. 1,917,341, issued 11 Jul. 1933, and Jarrett et al, GB Patent No. 503,226, issued 3 Apr. 1939, combine a clip and bendable wire end extension for securing hair to their devices. Fagerdala, German OT No. 1,915,547 of 1 Oct. 1970, is an example of coloring resilient hair styling devices and Spencer, U.S. Pat. No. 2,693,809, issued 9 Nov. 1954, is an example of using the resilient material as a supply source for treating fluid.

SUMMARY OF THE INVENTION

The invention is to a multipurpose hairstyling device. The device includes an elongated resilient material having a semi-rigid loop extending through the resilient material and around its outer periphery. The semi-rigid loop has pliable extensions attached to it adjacent the resilient material ends. The structure permits the elongated resilient material to assume various shapes by bending the semi-rigid loop into the desired shape. The pliable extensions add versatility to the device, such as by permitting different hair configurations by holding hair to the elongated resilient material adjacent its ends after hair has been rolled onto the central portion of the elongated resilient material or by attaching the pliable extensions together allowing the formation of the elongated resilient material into various closed loop regular or irregular shapes. With the closed loop shape, hair can be threaded through the central opening formed in the device.

DESCRIPTION OF THE PREFERRED EMBODIMENTS

Figure 1:
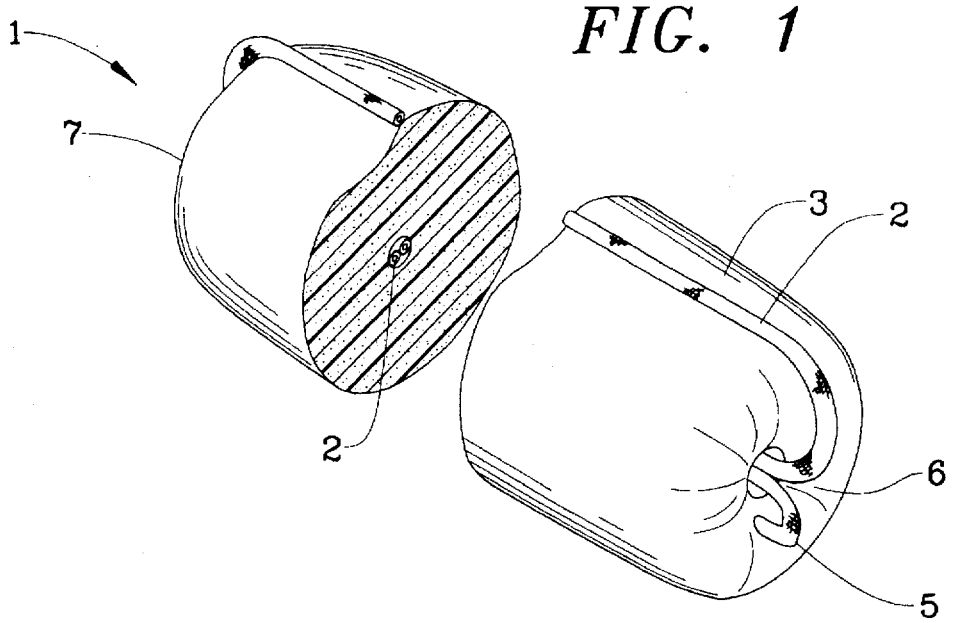
FIG. 1 is a partially broken away perspective view of the hairstyling device.

The improved hairstyling device 1 consists of an elongated resilient material 3 that has a semi-rigid but bendable loop 2 that extends into the elongated resilient material and around its outer extent. A first 4 and a second 5 pliable extension are attached to the endless loop adjacent the elongated resilient material ends. The first and second extensions can extend outwardly from the ends of the resilient material.

As shown in FIG. 1, the elongated resilient material 3 has a first end 6 and a second end 7. The resilient material is preferably a material that has a high coefficient of friction for firmly holding hair in position on it. The resilient material can be noncompressible but preferably is a soft, lightweight, elastic, compressible, porous rubber or plastic foam. If of foam, an open cell material can be used and charged with a perfume or treating material such as a hair setting material, oil, or the like. While the elongated resilient material can take various shapes, a cylindrical shape with rounded ends is preferred.

The semi-rigid loop 2 extends into the ends 6,7 of the elongated resilient material 3. The loop 2 is soft enough to be bent into any desired shape but firm enough to retain the shape it is bent into even with the elongated resilient material tending to return back into its original shape. While not necessary, it is preferred that the loop 2 be endless and that it extend through the elongated resilient material 3 and around the ends 6,7 and along the outer peripheral extent of the elongated resilient material. The loop can be made endless by joining together ends of a bendable material or by forming the elongated resilient material around an endless loop. By having the loop in contact with the elongated resilient material throughout its entire length, or essentially in contact with it, the shape the loop and resilient material is bent into is easier to maintain. The elastic characteristics of the resilient material and its friction with the hair, firmly hold the hair in place. The semi-rigid loop can be made of any appropriate material including some paper products and plastics, but a bendable metallic wire, such as lead, aluminum, stainless steel or copper, is preferred. While iron or other steel can be used, a non-rustable material is preferred. The material should be pliable enough to assume any shape it is bent into without breaking. A single thickness or diameter of such material can be used. A plurality of strands twisted together has advantages in that a stronger more pliable structure is usually formed.

Figure 2:
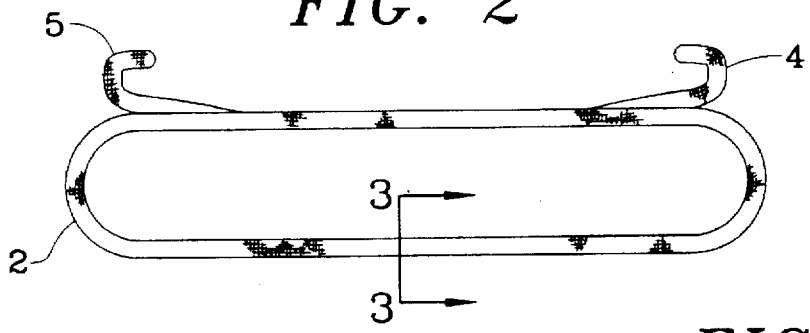
FIG. 2 is a partially broken away side view of the semi-rigid loop and extensions used in the hairstyling device.

As best shown in FIG. 2, the first 4 and second 5 pliable extensions are attached to the semi-rigid loop 2 at spaced locations intended to be adjacent the ends 6,7 of the elongated resilient material 3. Much like the loop 2, the extensions are bendable and able to retain the shape they are bent into. The same materials used for the loop can be used for the extensions 4,5. It is preferred that the extensions be positioned beneath the elongated resilient material adjacent the respective ends 6,7. In this position, the pliable extensions can be bent so as to independently extend around the semi-rigid loop and/or beneath the elongated resilient material, and be out of the way, or they can be used to clamp hair to the elongated resilient material, or they can be secured to each other to form the elongated resilient material into a circle or oval or other shape.

Figure 3:
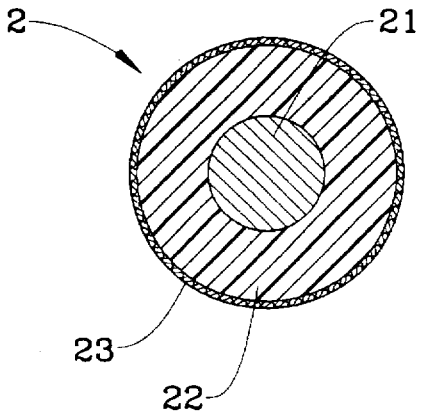
FIG. 3 is an enlarged cross-section through the semi-rigid loop on the line 3—3 of FIG. 2.

Both the first and second pliable extensions 4,5 and the semi-rigid loop 2 can be covered. One or more coatings or covers can be placed around the semi-rigid loop 2 and pliable extensions 4,5. FIG. 3 shows a cross-section of one acceptable combination. In this figure, the semi-rigid metallic loop center 21 is shown with two outer layers or coverings; a rubber or plastic coating 22 is covered with a fabric or cloth 23. The fabric or cloth can be cotton, silk, surgical tape, etc., depending on the desire for it to absorb or repel specific fluids the materials may be used with or come in contact with. The use of resilient or soft materials as a cover or coating can preclude uncomfortable contact with the head or scalp. The color of the coating or cover can be chosen to conform to the color of the hair being styled.

Figure 4:
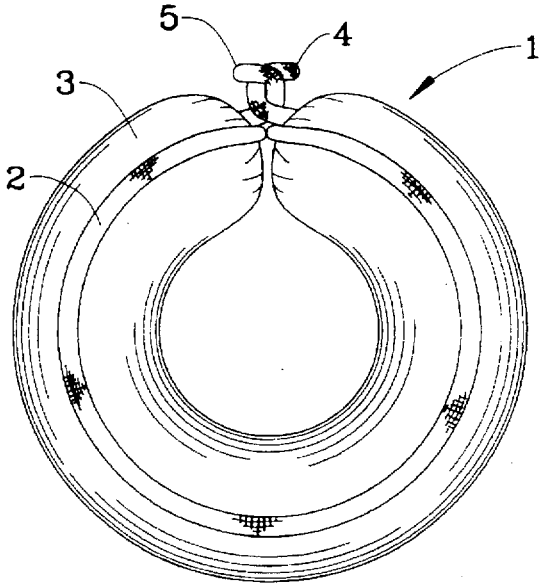
FIG. 4 illustrates the hairstyling device with the extensions secured together with the semi-rigid loop bent to form the hairstyling device into a circle.

The device can be used by pressing in the elongated resilient material 3 then inserting hair between the elongated resilient material and the semi-rigid loop 2. The release of the resilient material causes the hair to be clamped between the elongated resilient material and the semi-rigid loop. By turning the device, hair can be rolled around the device. The device can then be bent into a desired shape and left in that shape with the extensions wrapped around the semi-rigid loop 2 or pressed under the elongated resilient material 3 or used to secure the device in place on the head. Alternately, one or both of the pliable extensions can be used to press hair against the elongated resilient material in different arrangements. Also, the pliable extensions can be bent so as to be attached and secured together as shown in FIG. 4. By attaching the extensions together, the device can be bent into a circle or oval or other regular or irregular shape. Additional strands of hair can be drawn directly through the center of the device in these configurations. One of the devices can be used alone or two or more of the devices can be used in combination. Different effects can be obtained by using devices of different sizes. The size can vary by changing the diameter of the elongated resilient material, the length of the elongated resilient material, and/or the overall sizes of the device.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

I claim:

1. A hairstyling device including:

an elongated resilient material of essentially cylindrical shape with first and second ends having a first end surface and a second end surface and an outer surface;

a semi-rigid loop extending into said elongated resilient material for bending and shaping said elongated resilient material;

said semi-rigid loop being soft enough to be bent into different shapes but stiff enough to retain said different shapes;

said semi-rigid loop extending out from said elongated resilient material first end and extending adjacent and along and essentially in contact with said first end surface and along and essentially in contact with said outer surface and along and essentially in contact with said second end surface and into said elongated resilient material second end, said semi-rigid loop length outside said elongated resilient material being essentially the same as the shortest distance along said first end surface said outer surface and said second end surface so that by pressing said elongated resilient material, hair can be placed between and clamped between said elongated resilient material and said semi-rigid loop due to the return force exerted by said resilient material against said semi-rigid loop;

said elongated resilient material being a porous compressible foam material.

2. The hairstyling device of claim 1 wherein:

said semi-rigid loop is an endless loop that extends through said elongated resilient material.

3. The hairstyling device of claim 2 wherein:

said semi-rigid loop is a metallic wire.

4. The hairstyling device of claim 1 wherein:

said elongated resilient material outer surface and said semi-rigid loop are colored the color of the hair said device is to be used with.

5. The hairstyling device of claim 3 wherein:

said metallic wire is covered with a plastic coating that has a cloth cover over said plastic coating.

6. The hairstyling device described in claim 1 wherein:

said porous foam material is an open cell foam that has a high degree of friction with hair.

7. The hairstyling device of claim 6 wherein:

said open cell foam contains a treating material.

8. A hairstyling device including:

an elongated resilient material of essentially cylindrical shape with first and second ends having a first end surface and a second end surface and an outer surface;

a semi-rigid loop extending into said elongated resilient material that can be used for shaping said elongated resilient material;

said semi-rigid loop being soft enough to be bent into different shapes but stiff enough to retain said different shapes;

said semi-rigid loop extending out from said elongated resilient material first end and extending adjacent and along and essentially in contact with said first end surface and along and essentially in contact with said outer surface and along and essentially in contact with said second end surface and into said elongated resilient material second end so that by pressing said elongated resilient material, hair can be placed between and clamped between said elongated resilient material and said semi-rigid loop due to the return force exerted by said resilient material;

a first pliable extension extending from said semi-rigid loop adjacent said elongated resilient material first end;

a second pliable extension extending from said semi-rigid loop adjacent said elongated resilient material second end;

said first pliable extension and said second pliable extension being bendable and capable of gripping hair and capable of gripping each other.

9. The hairstyling device of claim 8 wherein:

said first pliable extension is attached to said semi-rigid loop under said elongated resilient material adjacent said first end, and said second pliable extension is attached to said semi-rigid loop under said elongated resilient material adjacent said second end so that said first and said second pliable extensions can be secured out of sight under said elongated resilient material.

10. The hairstyling device of claim 8 wherein:

said first and said second pliable extensions include a metallic wire.

11. The hairstyling device of claim 10 wherein:

said first and said second pliable metallic wire extensions are covered.

12. The hairstyling device of claim 8 wherein:

said semi-rigid loop is an endless loop that extends through said elongated resilient material;

said elongated resilient material is a porous compressible foam material.

13. The hairstyling device of claim 12 wherein:

said semi-rigid loop is a metallic wire;

said metallic wire is covered with a plastic coating;

said elongated resilient material outer surface and said metallic wire cover are colored the color of the hair said device is to be used with.

14. A hairstyling device including:

an elongated resilient material having first and second ends and an outer surface;

a semi-rigid loop extending along said elongated resilient material outer surface and into said elongated resilient material first and second ends;

a first pliable extension attached to said semi-rigid loop adjacent said elongated resilient material first end and independently extendable outwardly therefrom;

a second pliable extension attached to said semi-rigid loop adjacent said elongated resilient material second end and independently extendable outwardly therefrom.

15. The hairstyling device described in claim 14 wherein:

said semi-rigid loop is an endless loop.

16. The hairstyling device described in claim 14 wherein:

said semi-rigid loop and said first pliable extension and said second pliable extension include metallic wires.

17. The hairstyling device described in claim 16 wherein:

said metallic wires are covered with a cloth.

18. The hairstyling device described in claim 15 wherein:

said first pliable extension is attached to said semi-rigid loop under said elongated resilient material adjacent said first end;

said second pliable extension is attached to said semi-rigid loop under said elongated resilient material adjacent said second end.

19. The hairstyling device described in claim 17 wherein:

said elongated resilient material outer surface and said metallic wire cover are colored the color of the hair said device is to be used with.

20. The hairstyling device described in claim 14 wherein:

said first pliable extension and said second pliable extension are bent so that said first pliable extension is securely attachable to said second pliable extension.

* * * * *